United States Patent [19]

Langenfeld et al.

[11] Patent Number: 4,621,973

[45] Date of Patent: Nov. 11, 1986

[54] TRACTOR LOADER HAVING MULTI-ADJUSTMENT MOUNTINGS

[75] Inventors: Joseph W. Langenfeld; Neal W. Westendorf, both of Onawa, Iowa

[73] Assignee: Westendorf Mfg. Co., Inc., Onawa, Iowa

[21] Appl. No.: 773,260

[22] Filed: Sep. 6, 1985

[51] Int. Cl.[4] ..... E02F 3/62

[52] U.S. Cl. ..... 414/686

[58] Field of Search ..... 414/686, 723, 722, 697; 37/117.5

[56] References Cited

U.S. PATENT DOCUMENTS

| | | | |
|---|---|---|---|
| 4,051,962 | 10/1977 | Westendorf | 414/686 |
| 4,279,566 | 7/1981 | Sagaser et al. | 414/686 |
| 4,538,955 | 9/1985 | Langenfeld et al. | 414/686 |

*Primary Examiner*—Terrance L. Siemens

*Attorney, Agent, or Firm*—Zarley, McKee, Thomte, Voorhees & Sease

[57] ABSTRACT

A tractor loader is described which has multi-adjustment mounting features provided thereon to enable the loader to be mounted on a wide variety of tractor makes and models. First and second mounting brackets are adjustably mounted at opposite sides of the tractor and are adapted to have the tower assembly of the loader selectively mounted thereon. The tower assembly includes a pair of towers having side frame members extending forwardly therefrom. The lower ends of the towers have a shoe adjustably secured thereto which is secured to the first and second mounting brackets. A slide block is selectively longitudinally mounted on each of the side frames of the tower assembly which is also adjustably secured to the first and second mounting brackets.

9 Claims, 8 Drawing Figures

TRACTOR LOADER HAVING MULTI-ADJUSTMENT MOUNTINGS

BACKGROUND OF THE INVENTION

Many types of tractor loaders have been provided which are capable of being quickly mounted on a tractor and removed therefrom. Conventional "quick-attach" tractor loaders normally comprise a mounting frame means which is permanently secured to the tractor and a tower assembly which may be removably mounted thereon. A problem associated with the conventional tractor loaders is that the vast number of tractor makes and models require a tremendous inventory of the loaders to be maintained to enable the loaders to fit the various tractors. For example, some types of tractors are longer than others while other types of tractors are wider than others. Further, the positioning of the front wheels on the various tractors varies considerably.

SUMMARY OF THE INVENTION

It is therefore a principal object of the invention to provide a tractor loader having multi-adjustment mountings to enable the tractor loader to fit a variety of tractor makes and models.

First and second elongated brackets are longitudinally selectively mounted at opposite sides of the tractor and are interconnected with each other by elongated members. A mounting pad is provided at the forward end of each of the mounting brackets and has a roller bracket mounted thereon. Laterally extending supports are provided on each of the mounting brackets adjacent the rearward ends thereof. The tower assembly comprises a pair of towers having forwardly extending frame members provided at the lower ends thereof. Length-adjustable slide blocks are mounted on the forward ends of the frame members and are adapted to removably receive the roller brackets when the tower assembly is mounted on the tractor. A shoe is provided at the lower end of each of the towers which has a rearwardly presented opening formed therein which is adapted to receive the laterally extending mounting supports at the rearward end of the mounting bracket.

A further object of the invention is to provide a tractor loader which may be mounted on several different types of tractors through the adjustable mounting means provided thereon.

A further object of the invention is to provide a tractor loader which enables the normal inventory of loaders to be substantially decreased due to the fact that the tractor loader may be modified slightly so as to accommodate many different types of tractors.

Yet another object of the invention is to provide a tractor loader including mounting brackets which may be modified by means of mounting pads so that the loader can fit a variety of tractors.

Still another object of the invention is to provide a tractor loader wherein front and rear attaching points of the loader tower are adjustable and work together or independently.

These and other objects will be apparent to those skilled in the art.

DESCRIPTION OF THE PREFERRED EMBODIMENT

Figure 1:
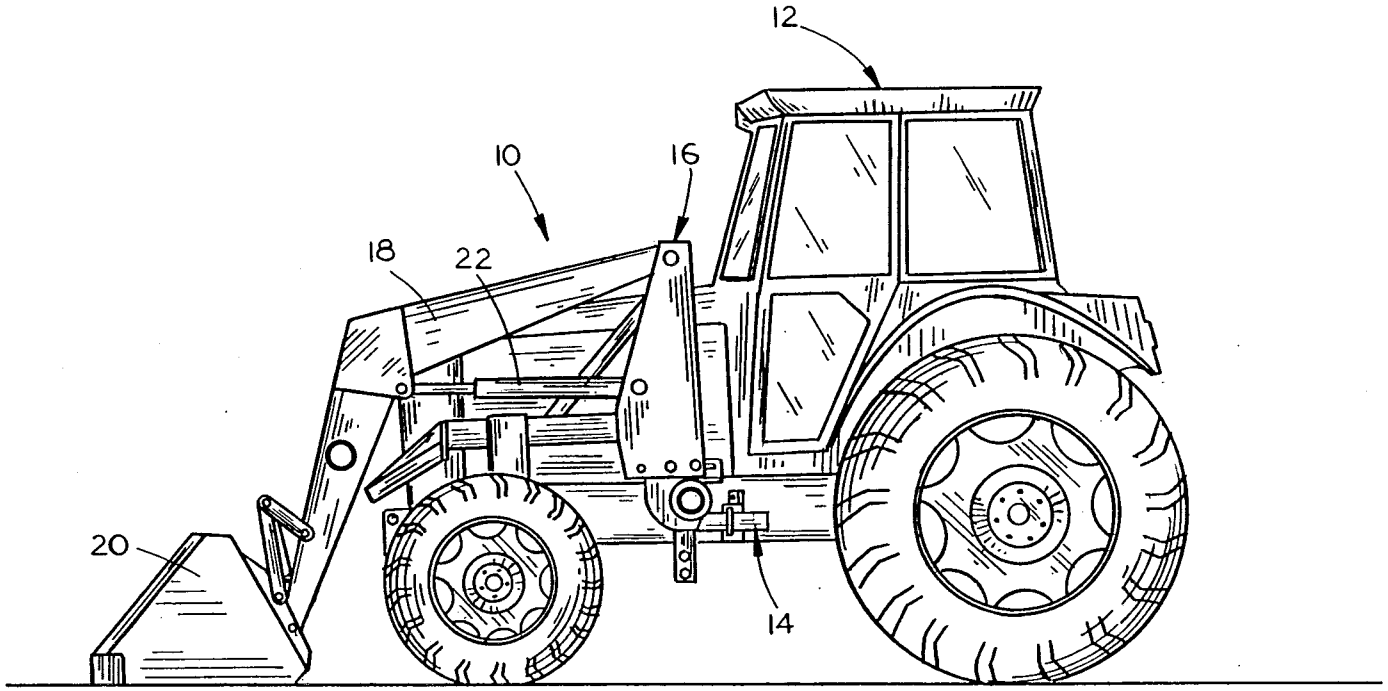
FIG. 1 is a side view of the tractor loader of this invention mounted on a tractor.

The loader device of this invention is referred to generally by the reference numeral 10 and is designed to be mounted on a tractor 12. Loader 10 generally comprises a mounting means or mounting bracket means 14 which is secured to the tractor as will be described in more detail hereinafter and which provides a means for mounting the tower assembly 16 thereon. Tower assembly 16 includes a pair of forwardly extending booms or loader arms 18 having a bucket or the like 20 mounted at the forward end thereof. Arms 18 are pivotally moved with respect to the tower assembly 16 by means of a pair of hydraulic cylinders 22.

Tower assembly 16 also includes a pair of uprights or towers 24 and 24' having frame members 26 and 26' secured thereto and extending forwarding therefrom adjacent the lower ends thereof respectively. Adjustable shoes 28 and 28' are secured to the lower ends of uprights 24 and 24' by means of bolts 30 and 30' respectively. Shoes 28 and 28' may be selectively moved rearwardly or forwardly relative to the associated upright as desired. Slide blocks 32 and 32' are selectively adjustably slidably mounted on the frame members 26 and 26'.

Figure 3:
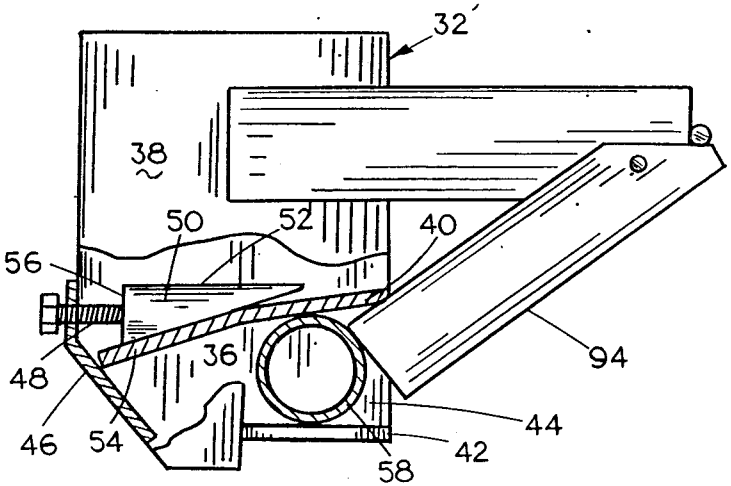
FIG. 3 is a sectional view illustrating the manner in which the adjustable slide block is mounted on the tower frame member and the manner in which the slide block is secured to the front roller bracket.

Each of the slide blocks 32 and 32' include a top portion 34 having sides 36 and 38 extending downwardly therefrom. Plate 40 is secured to and extends between the sides 36 and 38 as best seen in FIG. 3. Plate 42 is also secured to and extends between the sides 36 and 38 below plate 40 as best seen in FIG. 3 to create a pocket 44. Plate 46 is secured to and extends between the sides 36 and 38 adjacent the forward end thereof and has a bolt 48 threadably extending therethrough as seen in FIG. 3. Wedge block 50 is positioned within the slide block on the plate 40 and includes a top 52, bottom 54 and front end 56. Threadable rotation of the bolt 48 relative to the plate 46 causes the wedge block 50 to be moved inwardly on the inclined plate 40 so that top 52 of wedge block 50 moves upwardly to engagement with the bottom portion of the frame member 26 or 26'. Thus, the slide blocks 32 and 32' may be selectively positioned on the frame members 26 and 26' to enable the pockets 44 to receive the roller 58 which extends laterally from the roller bracket 60 as will be described in more detail hereinafter.

Mounting bracket 14 includes a pair of elongated frame members or bracket members 62 and 62'. Inasmuch as frame members 62 and 62' and the associated structure are identical, only frame member 62 will be described in detail. Frame member 62 is secured to the side of the tractor by inserting bolts or the like through the openings 64. Brace 66 is secured to the forward ends of the frame members 62 and 62' by bolt 68. The numerals 70 and 72 refer to shims which may be utilized if needed so that the mounting bracket can accommodate tractors having different widths. Similarly, brace 72 is secured at its opposite ends to arms 74 and 76 which extend downwardly from frame members 62 and 62' respectively by means of bolts 75. Shims 76 and 78 may be employed as desired to enable the mounting bracket means to accommodate tractors of different widths. Frame member 62 has a rearwardly extending post portion 80 which is adapted to be adjustably secured to bracket 82 by means of U-bolt assembly 84. Bracket 82 is secured to the side of the side of the tractor by suitable bolts or the like. The U-bolt connection between the post 80 and the bracket 82 enables the frame member 62 to be secured to the bracket 82 in such a manner so that the mounting bracket may be mounted on loaders having various lengths or the like.

Figure 2:
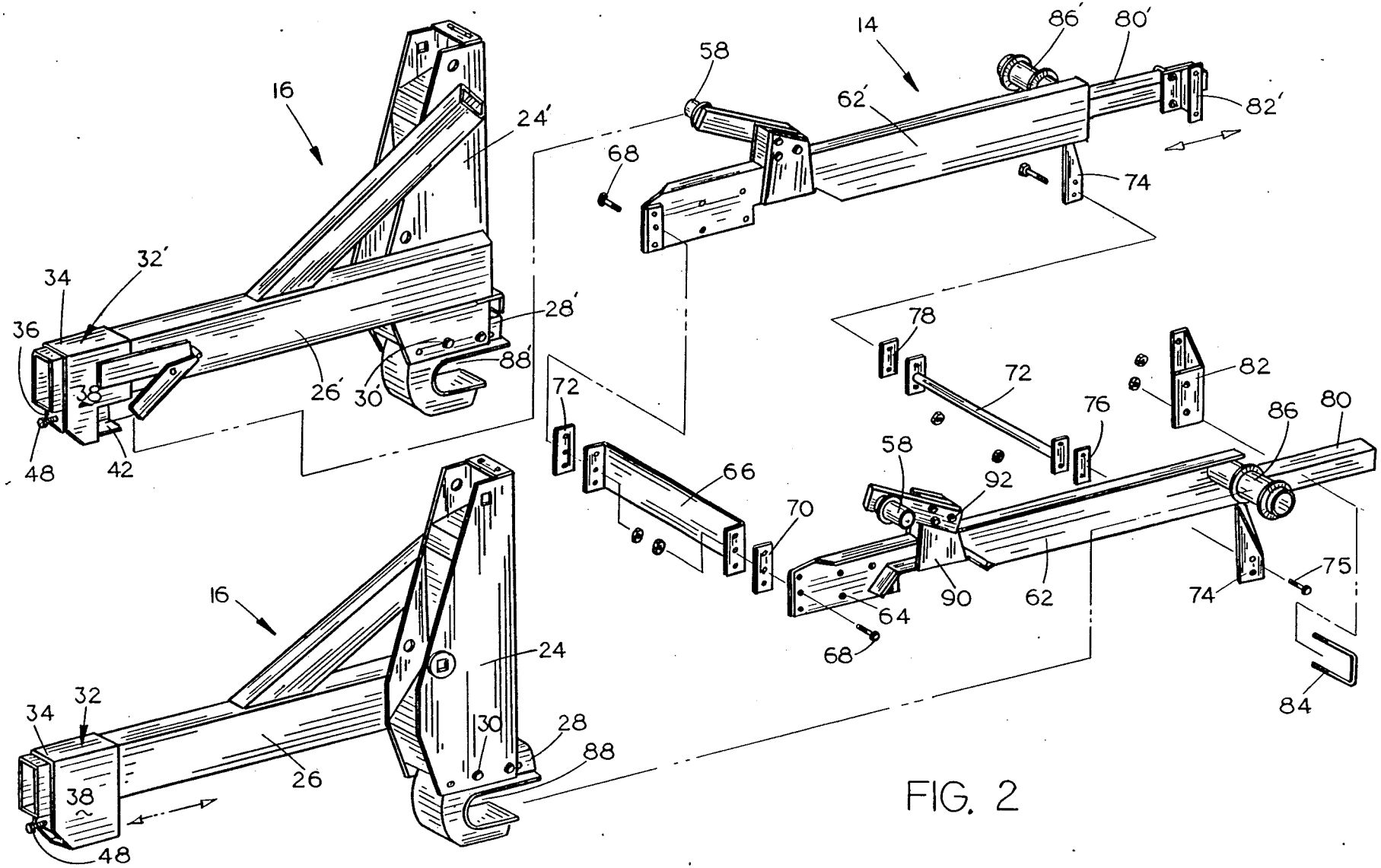
FIG. 2 is an exploded perspective view of the tractor loader of this invention less the boom arms and bucket.
Figure 4:
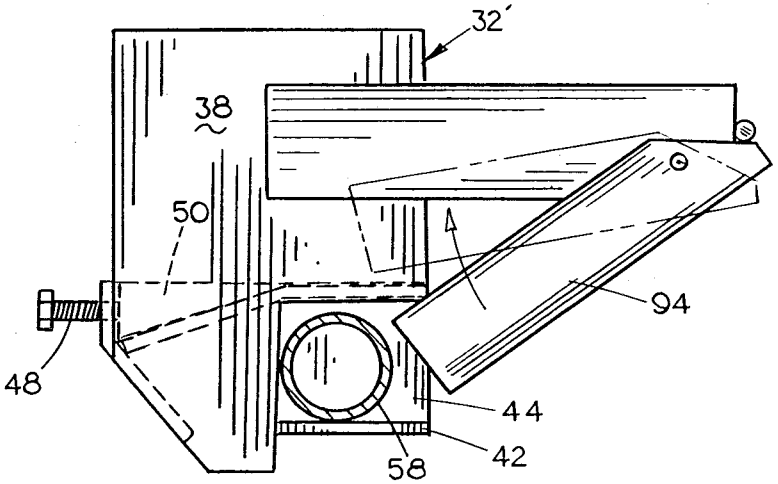
FIG. 4 is a view similar to FIG. 3.
Figure 7:
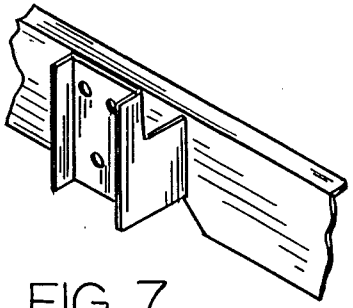
FIG. 7 is a perspective view illustrating a modified form of the mounting pad.
Figure 8:
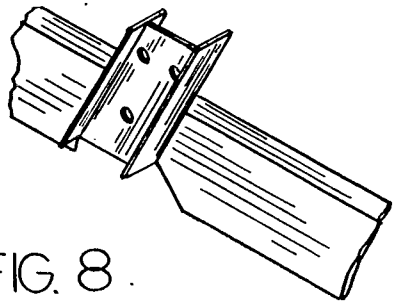
FIG. 8 is a perspective view illustrating a still further modified form of the mounting pad.
Figure 6:
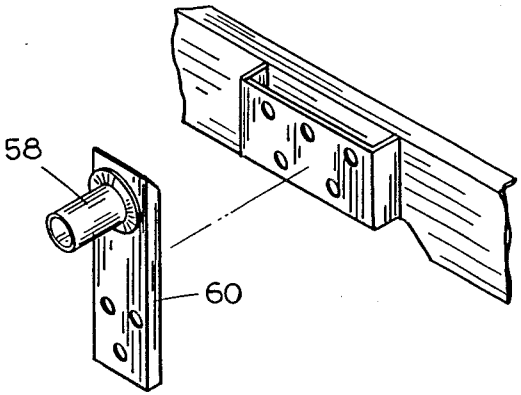
FIG. 6 is an exploded perspective view of one form of the mounting pad and roller bracket.

Mounting support 86 extends laterally from frame member 62 as best illustrated in FIG. 2 and is adapted to be received by the rearwardly presented U-shaped opening 88 in shoe 28. Mounting pad 90 is secured to frame member 62 rearwardly of the forward end thereof as the roller bracket 60 is selectively adjustably secured thereto by means of bolts 92. FIGS. 6, 7 and 8 illustrate various types of mounting pad configurations which may be utilized on the frame members 62 and 62' so that the roller 58 will be properly positioned to enable it to be received by the pockets 44 in the slide blocks 32 and 32'.

Figure 5:
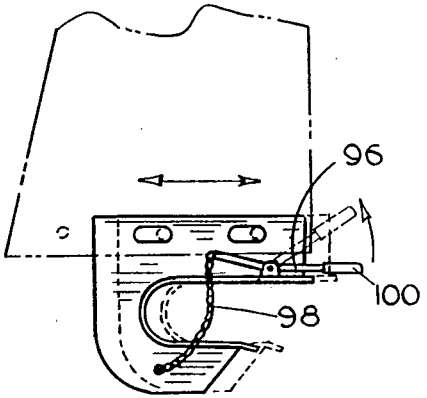
FIG. 5 illustrates one means of connecting the uprights to the mounting support.

The mounting bracket means 14 is mounted on the tractor and is normally left thereon even though the loader may not be mounted on the tractor. The means just described for adjustably mounting the mounting bracket means on the tractor enables the mounting bracket means to be mounted on various models and makes of tractors. The only major modification required to enable the frame members 62 and 62' to be mounted on a wide variety of tractors is to change the mounting pad configuration. The roller bracket 60 on each of the frame members 62 and 62' is identical which further reduces the required inventory. Not only is the mounting bracket adaptable for many types of tractors, the mounting bracket is extremely strong and durable. When the tower assembly is mounted on the mounting bracket means, the rollers 58 on the roller bracket 60 are received by the pockets 44 in the slide blocks 32 and are maintained therein by the locking lever 94. If additional locking is needed, the lock means 96 illustrated in FIG. 5 may be employed. Lock means 96 includes a flexible chain 98 which is adapted to be extended around the rearward end of the support 86 and maintained in engagement therewith by the lever 100.

It is important to note that both the front and rear attaching points of the loader tower are adjustable. The adjustable connections are completely adjustable but yet provide the needed security to maintain a positive and secure connection.

Thus it can be seen that a novel loader has been provided which includes adjustable mounting means so that the loader can be mounted on a vast number of different tractor makes and models. Thus it can be seen that the invention accomplishes at least all of its stated objectives.

We claim:

1. A loader device for a tractor, comprising, a first and second mounting bracket means mounted at opposite sides of the tractor and having rearward and forward ends, a first mounting pad means secured to said first mounting bracket means adjacent the forward end thereof, a second mounting pad means secured to said second mounting bracket means adjacent the forward end thereof, first and second roller brackets selectively removably secured to said first and second mounting pad means and extending upwardly therefrom, first and second rollers mounted on the upper ends of said first and second roller brackets respectively and extending horizontally outwardly therefrom, first and second mounting supports on said first and second mounting bracket means respectively and extending outwardly therefrom rearwardly of said roller brackets, a tower assembly removably mounted on said first and second mounting bracket means, said tower assembly comprising a generally U-shaped frame means including first and second side frame members having rearward and forward ends and a front frame member secured to and extending between the forward ends of said side frame members; first and second towers secured to the rearward ends of said first and second side frame members respectively, each of said towers having an upper end positioned above the associated side frame member and a lower end positioned positioned below the associated side frame member, a shoe assembly secured to the lower end of each of said towers and having a rearwardly presented opening which receives one of said mounting supports therein, a slide block means selectively longitudinally adjustably mounted on each of said side frame members forwardly of said towers and having a rearwardly presented opening which receives one of said rollers therein, means for selectively locking said tower assembly on said first and second mounting bracket means, and a pivotal boom means mounted on said towers.

2. The loader device of claim 1 wherein said first and second roller brackets are identical.

3. The loader device of claim 1 wherein a front frame member is secured to and extends between the forward ends of said first and second mounting bracket means, and shims selectively positioned between the ends of said front frame member and said first and second mounting bracket means.

4. The loader device of claim 3 wherein an arm is secured to and extends downwardly from each of said side frame members, an elongated brace secured to and extending between said arms, and shims selectively positioned between the ends of said brace and said arms.

5. The loader of claim 1 wherein said roller brackets are adjustably mounted on said mounting pads.

6. The loader of claim 1 wherein said shoes are adjustably mounted on said towers.

7. The loader of claim 1 wherein said first and second mounting bracket means are adjustably mounted on the tractor.

8. The loader of claim 1 wherein said means for selectively locking said tower assembly on said first and second mounting bracket means comprises a length adjustable clamping means on said shoes.

9. The loader of claim 1 wherein said means for selectively locking said tower assembly on said first and second mounting bracket means comprises a latch assembly mounted on each of said slide block means which may be selectively moved into engagement with the roller received in said rearwardly presented opening therein.

* * * * *